US006234831B1

(12) United States Patent
Hanaoka

(10) Patent No.: US 6,234,831 B1
(45) Date of Patent: May 22, 2001

(54) CABLE HOUSING DEVICE

(75) Inventor: Taira Hanaoka, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/428,536

(22) Filed: Oct. 28, 1999

(30) Foreign Application Priority Data

Oct. 28, 1998 (JP) ..... 10-307235

(51) Int. Cl.[7] ..... H01R 13/72; H01R 13/58
(52) U.S. Cl. ..... 439/501; 439/458
(58) Field of Search ..... 439/501, 456, 439/457, 458, 459

(56) References Cited

U.S. PATENT DOCUMENTS 4,493,134 * 1/1985 Karr ..... 24/132 WL

FOREIGN PATENT DOCUMENTS 48-83379 1/1947 (JP) .
48-93374 2/1947 (JP) .
54-135681 3/1953 (JP) .
54-84296 7/1979 (JP) .

* cited by examiner

*Primary Examiner*—Paula Bradley
*Assistant Examiner*—Edwin A. León
(74) *Attorney, Agent, or Firm*—Foley & Lardner

(57) ABSTRACT

A cable housing device in which an excess cable portion is taken care of dexterously to make effective utilization of an available desk top surface to improve the appearance and to eliminate cable entanglements or the like problems. A cable housing device CA1 accommodating a cable 103 interconnecting a main body 101 of an information processing device and a manual operating unit 102. The cable housing device is constituted by a cable housing unit 10, substantially in the form of a flat plate, having an opening (outlet) 14 for pulling out an end of the cable and another opening (outlet) 15 for pulling out the other cable end. The two openings are interconnected by a curved cable housing groove 12.

9 Claims, 5 Drawing Sheets

CABLE HOUSING DEVICE

FIELD OF THE INVENTION

This invention relates to a cable housing device and, more particularly, it relates to a cable housing device preferably used for a desk setting type information processing device.

BACKGROUND OF THE INVENTION

The information processing device, such as a personal computer, there are those devices in which a display unit and a control unit (monitor) are provided separately from a manual operating unit (keyboard and mouse). This type of the device is termed a separate type device.

The separate type device may be classified into a type presupposed to be set on a desk of an office (desk setting type) and a type presupposed to be set on a floor (floor setting type). In the separate type device, the monitor and the keyboard/mouse need to be interconnected by a cable.

FIG. 6 shows a typical using environment of a conventional desk setting type personal computer.

Referring to FIG. 6, a connector 104 is connected to a left lateral side of a rectangular base table 101*a* of a monitor 101 and is connected over a cable 103 to a keyboard 102.

On the other hand, an information processing device of the type in which the keyboard or the mouse is connected to a display device (monitor) has made its debut as a USB (universal serial bus) recently has come into widespread use. In this case, it is similarly necessary to interconnect the monitor and the keyboard/mouse over a cable.

SUMMARY OF THE DISCLOSURE

However, in the separate type information processing device, the keyboard and the mouse are routinely used in common by both the floor setting type device and the desk setting type device. In this case, the length of the connection cable is designed using the floor setting type device as a reference. Therefore, if the cable for the floor setting type device is used for the desk setting type device, there results an excess length of the cable to raise a variety of operational problems, such as decreased desk top surface, poor appearance or cable entanglement. In FIG. 6, the cable with an excess length portion extends in a extensively curved fashion.

It is therefore an object of the present invention to provide a cable housing device in which, by dexterously disposing of the excess cable portion, the desk top surface can be utilized effectively and which is superior in appearance and free from operational problems, such as cable entanglements.

For accomplishing the above object, the present invention provides a cable housing device for accommodating a cable interconnecting a main body of an information processing device and a manual actuating unit (or module), wherein the cable housing device comprises a cable housing member in the form of a flat plate. This cable housing member has an opening for accommodating one end of the cable and another opening for accommodating its other end. The cable housing member also has a curved cable-housing groove interconnecting the one and the other openings.

If the main body portion of the information processing device is to be connected to the manual actuating unit via a cable, an excess length portion of the cable is accommodated in the curved cable-housing groove in the cable housing member. If the curved portions are increased in number, a considerably longer excess portion of the cable can be accommodated in these curved portions. The groove is preferably formed in a meander fashion line "S" letter or a combination thereof. Various modified patterns of the S-shaped meander groove may be employed.

Other aspects and features of the present invention are disclosed in the appended claims which are herein incorporated by reference thereto.

BRIEF DESCRIPTION OF THE DRAWINGS

FIG. 3 illustrates the operation of the first embodiment, wherein

PREFERRED EMBODIMENTS OF THE INVENTION

Figure 1:
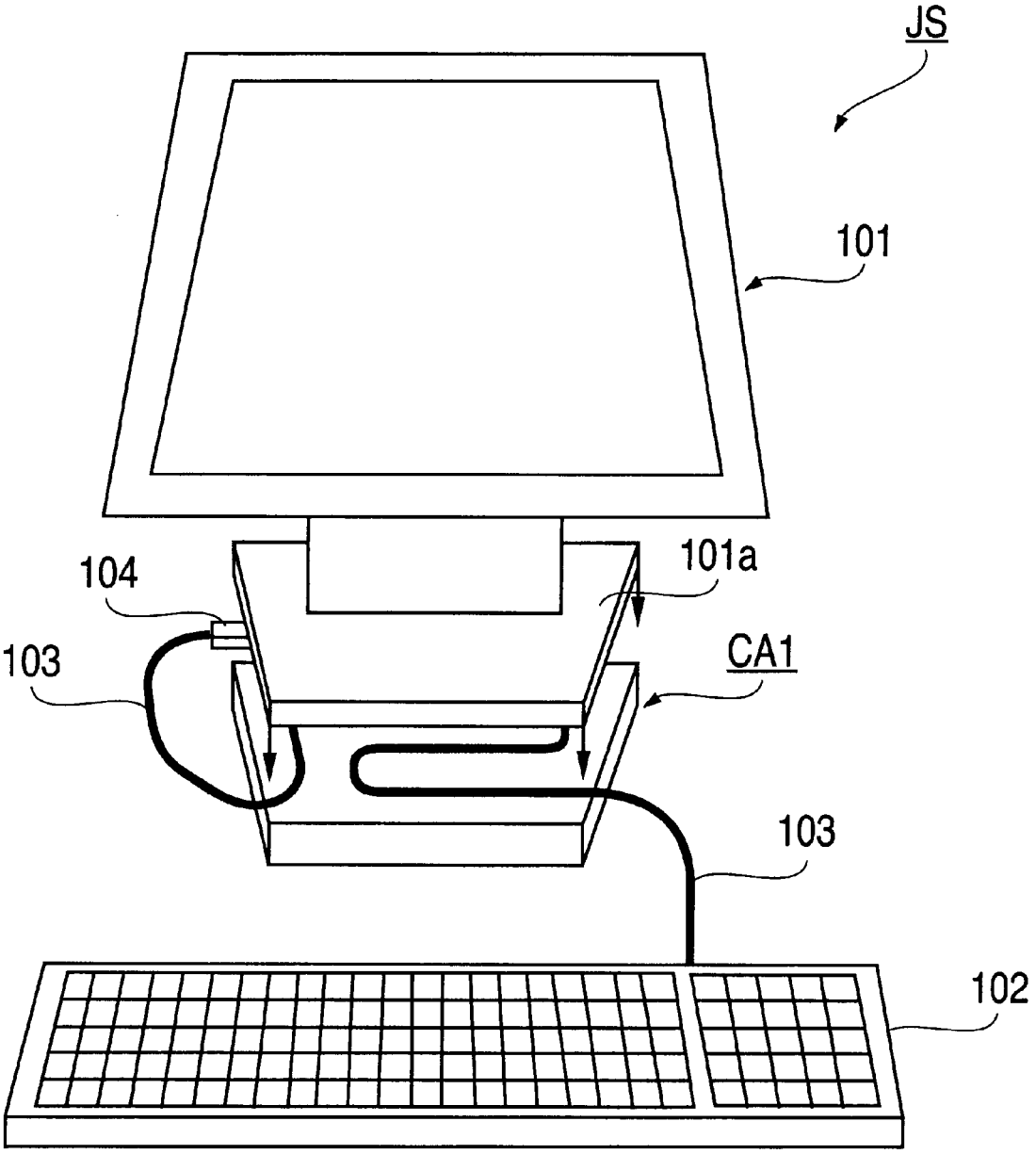
FIG. 1 is a schematic view showing the system of a first embodiment of the present invention.

The present invention is hereinafter explained with reference to preferred embodiments thereof. The portions already explained are depicted by the same reference numerals and are not explained specifically.

(1) First Embodiment

Figure 2:
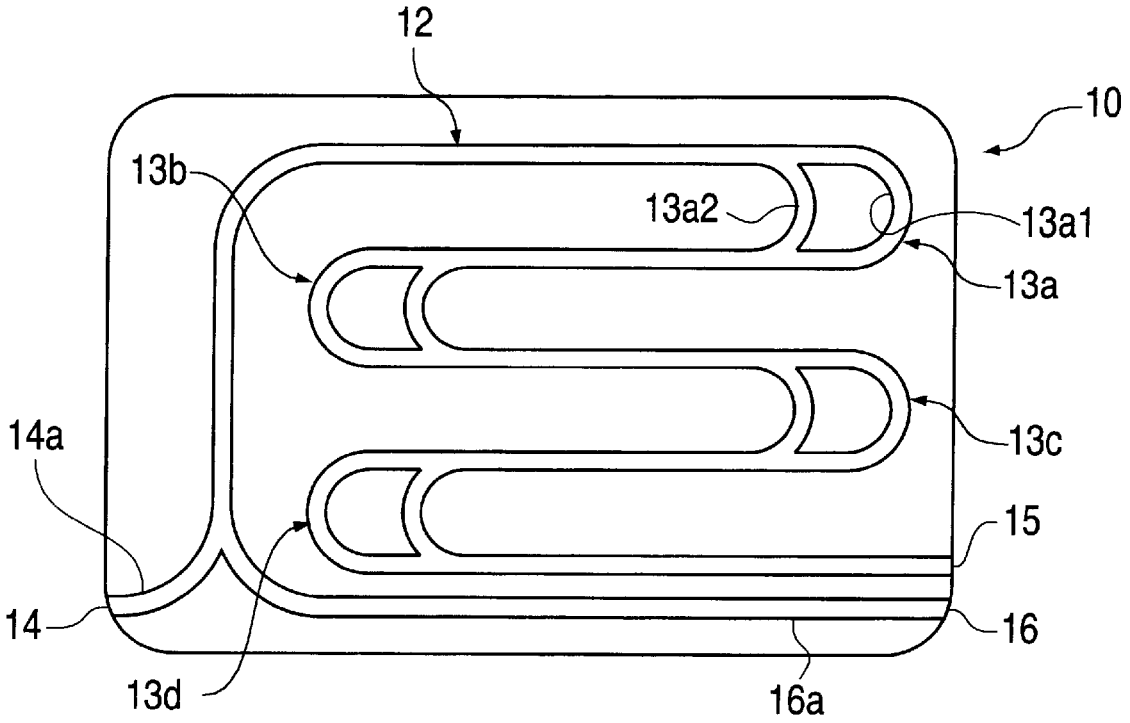
FIG. 2 is a plan view showing the cable housing unit of the first embodiment.

FIG. 1 schematically shows an information processing device system JS employing a cable adjuster CA1 which is a cable housing device embodying the present invention. FIG. 2 shows a cable adjuster CA1 in a plan view.

Referring to FIG. 1, the information processing device system JS includes a monitor 101, a cable adjuster CA1 according to the present invention, a keyboard 102 and a cable 103. The monitor 101 is placed set on the cable adjuster CA1 upon use.

Referring to FIGS. 1 and 2, a cable housing unit 10, constituting the cable adjuster CA1, is a flat substantially rectangular member of a small thickness, formed of, for example synthetic resin.

The cable housing unit 10 includes an S-shaped meander groove 12, housing the cable 103, this groove 12 having four curved points 13*a*, 13*b*, 13*c*, 13*d* having proceeding directions inverted through 180 degrees as shown. For example, the right upper curved point 13*a* has an outer curved portion 13*a*1 and an inner curved portion 13*a*2 by-passing the curved portion 13*a*1. Similarly, the remaining curved portions 13*b*, 13*c* and 13*d* have outer and inner curved portions.

The left lateral side of the cable housing unit 10 is provided with a first opening (outlet) 14 for leading out an end of the cable 103, whilst the right lateral side thereof is provided with a second opening 15 for leading out the other end of the cable 103. Below the second opening 15, there is formed a third opening 16. A groove path 16*a* from the third opening 16 is designed to merge smoothly confluent with a groove path 14*a* from the first opening 14.

The operation of the present embodiment is explained with reference to FIGS. 3A, 3B and 4.

Figure 3A:
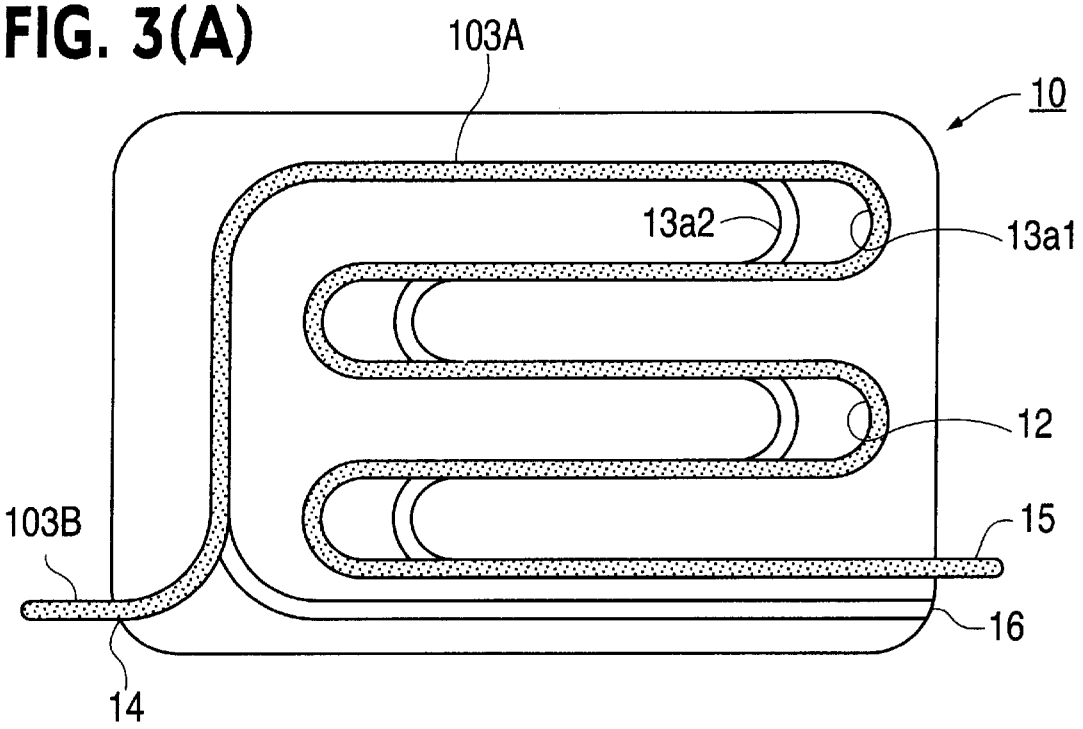
FIG. 3A shows a cable housing route in case the cable has a long excess length portion and FIG. 3B shows a cable housing route in case the cable has a short excess length portion.
Figure 3B:
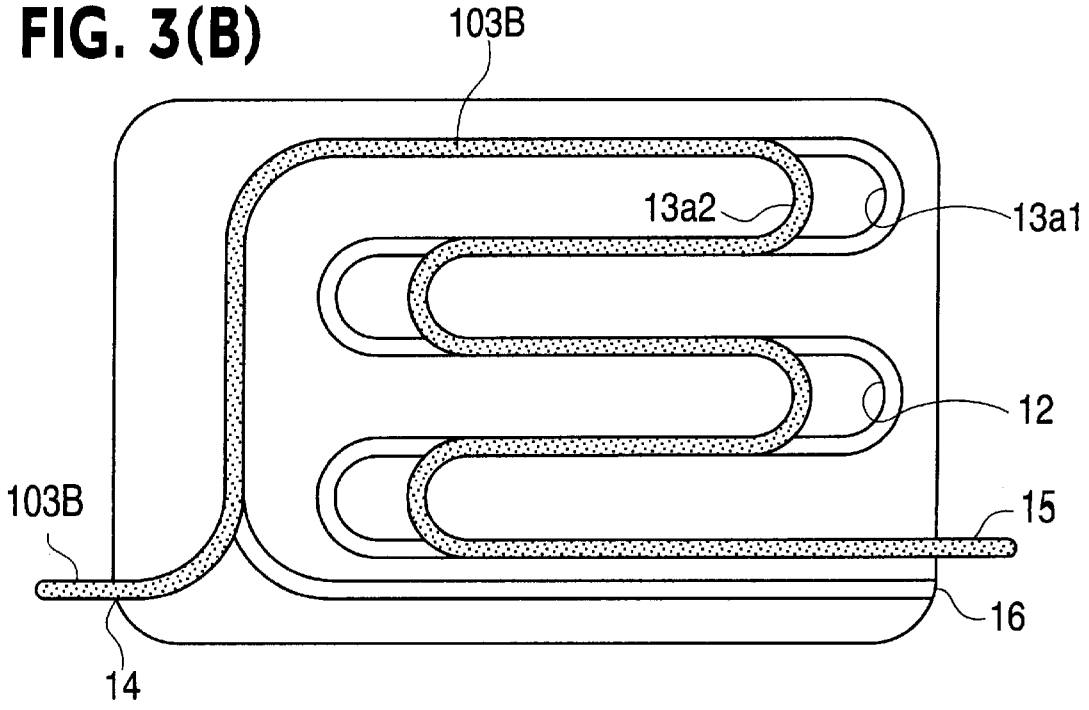

In FIGS. 3A and 3B, the cable housing route is to be changed depending on the relative length (short or long) of the cable 103.

FIG. 3A shows a case in which the cable 103A is of a long length. The cable housing route for the cable 103A is a route passing through the four outer curved portions 13*a*1 etc of the groove 12.

FIG. 3B shows a case in which the cable 103B is of a short length. The cable housing route for the cable 103B is a route passing through the four inner curved portions 13*a*2 etc of the groove 12. The inner curved portions 13*a*2 etc. form a short cut bypass for any of the outer curved portions.

If the cable to be housed is of a length intermediate between the lengths of the cables 103A and 103B, it suffices to select the outer and inner curved portions appropriately to accommodate the cable in the selected curved portions.

Figure 6:
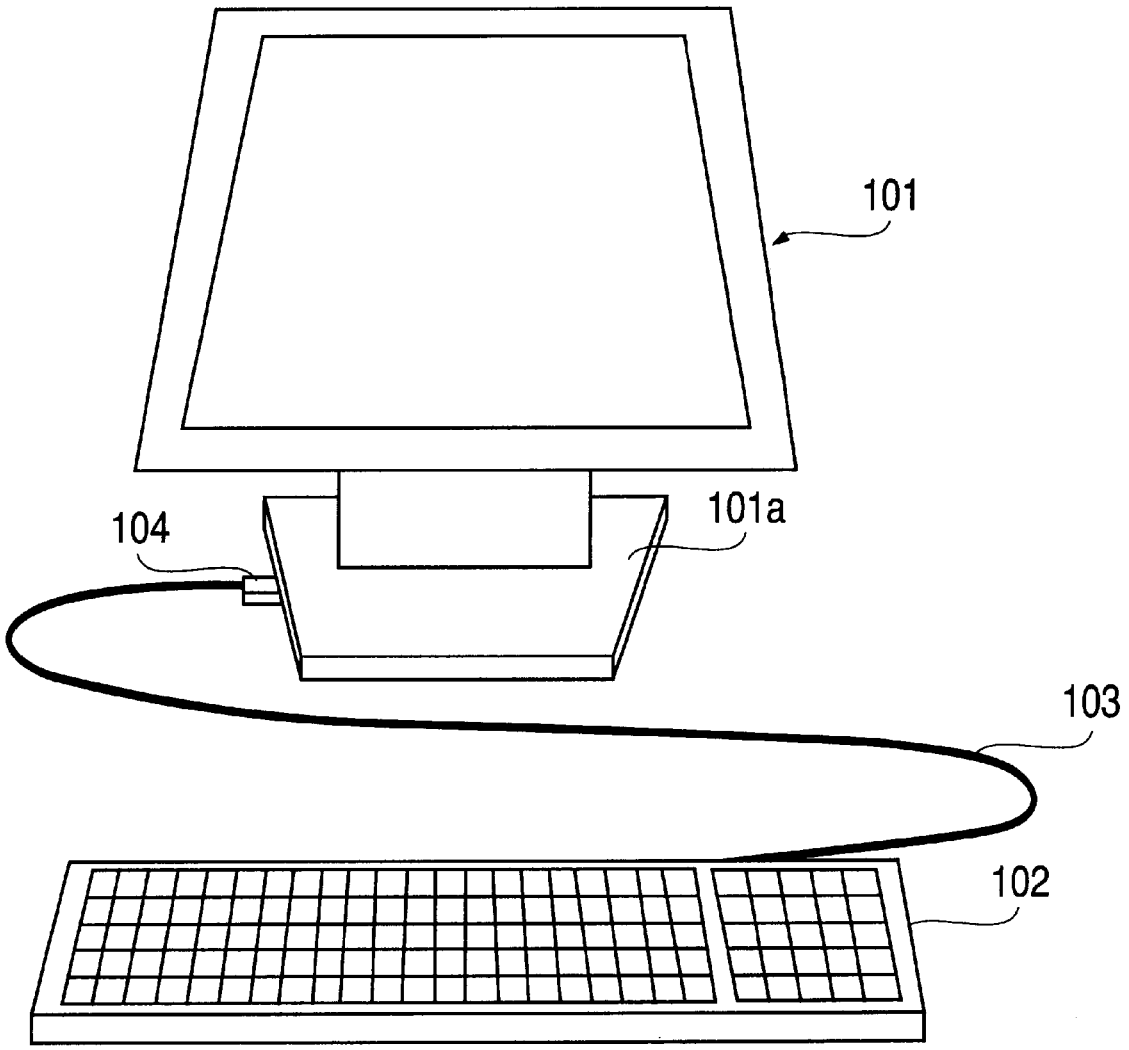
FIG. 6 (PRIOR ART)
FIG. 6 is a schematic view showing a conventional system of the desk top setting type information processing device.

Since the excess length portions of the cable can be housed in this manner in the inner curved portions of the cable housing unit 10, depending on the relative length of the excess length portion, the available space of the desk top can be effectively utilized, as will be apparent from comparison of FIGS. 1 and 6, thus improving the appearance, while evading operational problems, such as cable entanglements.

Figure 4:
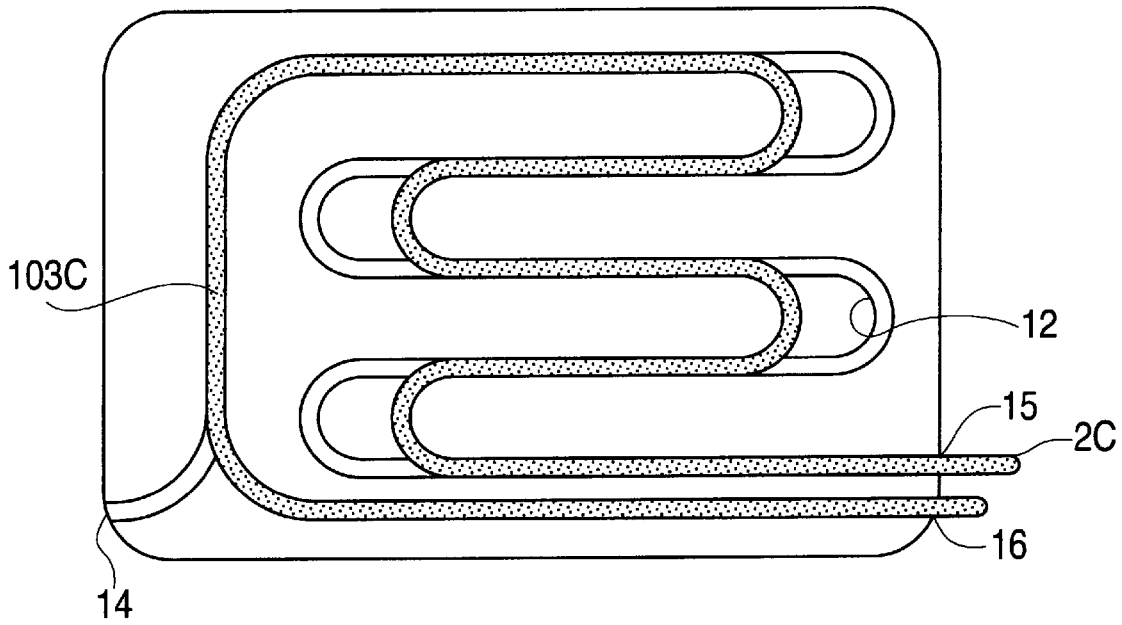
FIG. 4 illustrates the operation of the first embodiment, and specifically shows both cable ends extracted from the same lateral side.

FIG. 4 shows a case in which two openings (outlets) 15, 16 for a cable 103C are in the same direction. Namely, one end 2C of the cable 103C enters the opening 15 and comes out of the opening 16 neighboring the opening 15.

This enables effective utilization of the available space on the desk top surface depending on the constraints of the desk on which the information processing device system JS is set.

Second Embodiment

Figure 5:
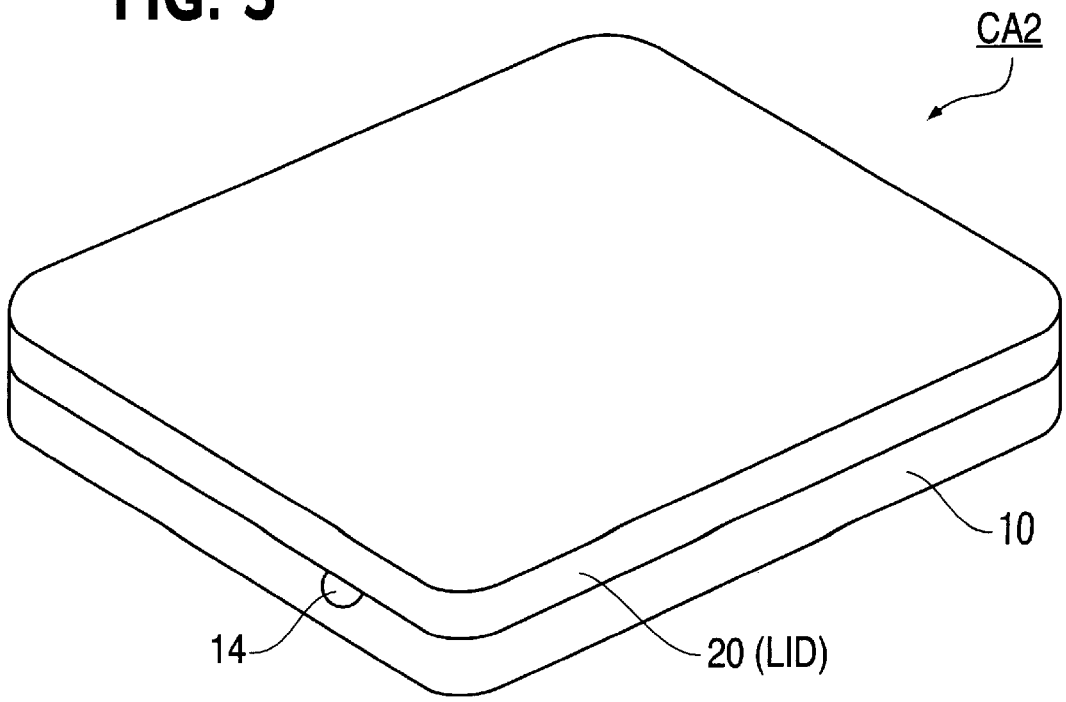
FIG. 5 is a perspective view showing a cable adjuster of a second embodiment of the present invention.

FIG. 5 shows, in a perspective view, the appearance of the cable adjuster CA2 of a second embodiment.

In the first embodiment, in distinction from the present second embodiment, the base table 101*a* (see FIG. 1) of the monitor 101 is set on the upper surface of the cable housing unit 10, with the groove formed on the upper surface of the cable housing unit 10 being exposed to outside.

In the present embodiment, a lid 20 is applied on the upper surface of the cable housing unit 10. The monitor 101 is set on the lid 20 of the cable adjuster CA2 in order to utilize the information processing device system.

By so doing, it is possible to accommodate the excess portion of the existing desk top setting type within the inside of the cable adjuster CA2 to permit the cable to pass simply through the cable adjuster CA2, so that a similar effect to that of the first embodiment can be achieved.

If plural cable adjusters, such as those shown in FIGS. 2 and 5, are used, it is possible to accommodate cables of still longer lengths while the neat appearance of the entire device is maintained.

The meritorious effects of the present invention are summarized as follows.

According to the present invention as described above, since the excess cable length disappear from the desk top, it becomes possible to eliminate the problem of cable entanglements to improve the tractability.

Since the space on the desk top, otherwise occupied by the excess cable length portion, can be utilized effectively, space saving can be achieved.

Moreover, since the excess length portion of the cable, otherwise loosely dangling on the back side of the desk, is accommodated in the cable housing unit, the system can be improved in appearance.

It should be noted that other objects and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A cable housing device for accommodating a cable interconnecting a main body of an information processing device and a manual actuating unit, wherein said cable housing device comprises a cable housing member in the form of a single flat plate, said cable housing member having an opening for accommodating one end of the cable and another opening for accommodating the other end thereof;

said cable housing member also having a curved cable-housing groove interconnecting said one opening and said other opening, wherein said curved cable housing groove includes at least one S-shaped curved portions and wherein a curved portion of such S shape has an outer curved portion and an inner curved portion by-passing said outer curved portion.

2. The cable housing device as defined in claim 1 wherein a plurality of said curved cable housing grooves are formed.

3. The cable housing device as defined in claim 1, wherein said cable housing member is covered with a lid.

4. The cable housing device as defined in claim 1, wherein said main body is adapted to be placed on a desk, said main body is adapted to be placed on said cable housing device.

5. The cable housing device as defined in claim 1, wherein said main body is adapted to be placed on said cable housing device.

6. The cable housing device as defined in claim 1, wherein said cable housing device is adapted to be stacked together upon which said main body is placed.

7. The cable housing device as defined in claim 1, wherein said cable housing member in the form of a flat plate is rectangular and wherein said one opening and said other opening are formed on one of lateral surfaces of said rectangular cable housing member.

8. The cable housing device as defined in claim 7, wherein there is provided with at least one further opening which smoothly merges with said groove at intermediate of said groove.

9. The cable housing device as defined in claim 8, wherein said at least one further opening is disposed on the lateral surfaces other than said one of lateral surfaces.

* * * * *